US007059222B2

(12) United States Patent
Hsien

(10) Patent No.: US 7,059,222 B2
(45) Date of Patent: Jun. 13, 2006

(54) SLIDE STOP DEVICE OF A HEXAGONAL SPANNER

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 142 days.

(21) Appl. No.: 10/867,312

(22) Filed: Jun. 15, 2004

(65) Prior Publication Data

US 2005/0274238 A1 Dec. 15, 2005

(51) Int. Cl.
*B25B 23/10* (2006.01)

(52) U.S. Cl. ..... 81/443; 81/448

(58) Field of Classification Search ..... 81/441–445, 81/447–449, 461
See application file for complete search history.

(56) References Cited

U.S. PATENT DOCUMENTS 1,058,454 A * 4/1913 Moores ..... 279/7
2,404,427 A * 7/1946 Bloomfield ..... 81/443
2,991,674 A * 7/1961 Uhl ..... 72/393
3,600,984 A * 8/1971 Bihlmaier ..... 81/2
4,696,102 A * 9/1987 Overbay ..... 29/726
4,724,608 A * 2/1988 Parrott ..... 29/724
5,025,688 A * 6/1991 Davis ..... 81/448
5,927,165 A * 7/1999 Vasudeva ..... 81/448

* cited by examiner

*Primary Examiner*—David B. Thomas

(57) ABSTRACT

A slide stop device of a hexagonal spanner serves for preventing a rounded edged inner hexagonal screw to slide as the hexagonal spanner drives the inner hexagonal screw. The slide stop device comprises a spanner body; one end of the spanner body having a driving portion; the driving portion having three axial slots; and a screw hole extending from the tapered hole; a resisting element formed by a screw unit, a tapered resisting unit having a shape corresponding to that of the tapered hole, and a spring. In assembly, the screw unit and the resisting unit are placed in the tapered hole; and the spring is placed between the tapered hole and the resisting unit. The screw unit is screw into the screw hole, while a head of the screw unit resists against the step portion and a part of the resisting element exposes from the tapered hole.

2 Claims, 5 Drawing Sheets

SLIDE STOP DEVICE OF A HEXAGONAL SPANNER

FIELD OF THE INVENTION

The present invention relates to spanners for driving hexagonal screws, and particular to a slide stop device of a hexagonal spanner.

BACKGROUND OF THE INVENTION

In general, if a screw is used for a longer time, the screw will round so that it is difficult to drive the screw by a spanner. Thereby, it is often that the screw must be destroyed for taking the screw out. This will destroy the work piece.

Thereby, to improve the defect in the prior art, there are some ways are developed for resolving the prior art problem.

However, all these improvements are aimed to improve outer hexagonal screws (that is, a screw has a hexagonal driving portion at an outer side of the screw) instead of improving inner hexagonal screws (that is, a screw has a hexagonal driving portion at an inner side of the screw).

This is because, referring to FIG. 7, the conventional spanner for driving an inner hexagonal screw has a solid structure with an L shape which does not deform. Each spanner is designed for screws with predetermined sizes. As the inner hexagonal screw has rounded edges so that as the hexagonal screw is driven, it will slide with respect to the spanner so that it can not be effectively driven.

However, for the outer hexagonal screws, the conventional spanner has expandable claming portions at two ends thereof so that as the edges of the hexagonal portion of an outer hexagonal screw are rounded, the clamping portions can deform to match the round edges of the outer hexagonal screws, but no this mechanism is design for the convention spanner for driving the inner hexagonal screws.

SUMMARY OF THE INVENTION

Accordingly, the primary object of the present invention is to provide a slide stop device of a hexagonal spanner for preventing a rounded edged inner hexagonal screw to slide as the hexagonal spanner drives the inner hexagonal screw; the slide stop device comprising: a spanner body; one end of the spanner body having a driving portion; the driving portion having three axial slots; and a screw hole extending from the tapered hole; a resisting element formed by a screw unit, a tapered resisting unit having a shape corresponding to that of the tapered hole, and a spring. In assembly, the screw unit and the resisting unit are placed in the tapered hole; and the spring is placed between the tapered hole and the resisting unit; the screw unit is screw into the screw hole, while a head of the screw unit resists against the step portion between the through holes and a part of the resisting element exposes from the tapered hole.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
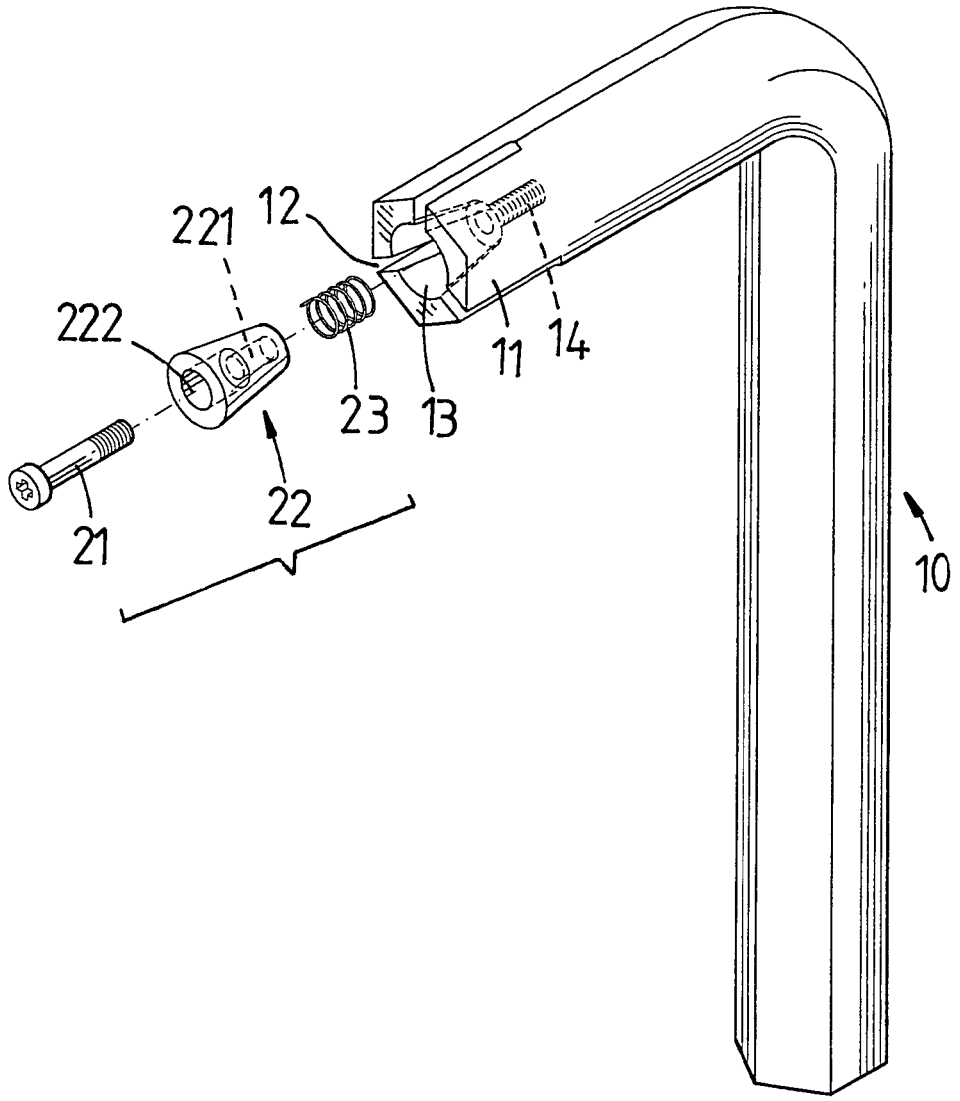
FIG. 1 is an exploded perspective view of a first embodiment of the slide stop device of a hexagonal spanner of the present invention.
Figure 2:
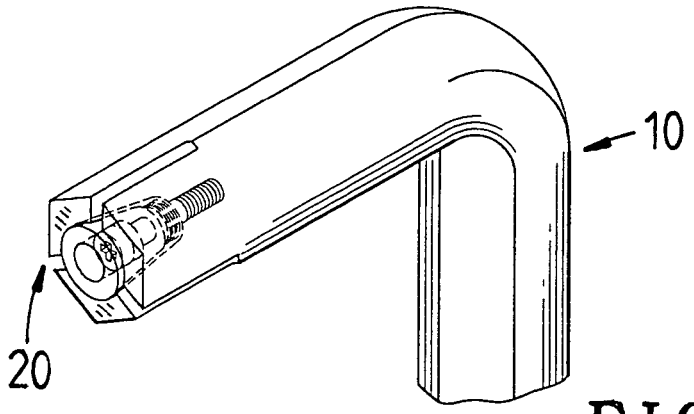
FIG. 2 shows an assembled view of the slide stop device of a hexagonal spanner of the present invention.

With reference to FIGS. 1 and 2, the slide stop device of a hexagonal spanner of the present invention is illustrated. The slide stop device of a hexagonal spanner includes the following elements.

A spanner body 10 is enclosed. One end of the spanner body 10 has a driving portion 11. The driving portion 11 has three axial slots 12. Each slot is extended from a center of one end surface of the driving portion 11 to apexes or lateral sides of a hexagonal cross section of the driving portion 11. A tapered hole 13 is formed along an axial direction of driving portion 11. A screw hole 14 extends from an inner side of the tapered hole 13 and is at the same line with the tapered hole 13.

A resisting element 20 is formed by a screw unit 21, a tapered resisting unit 22 having a shape corresponding that of the tapered hole 13, and a spring 23. The resisting unit 22 has two through holes 222, 221. Two through holes 222, 221 are communicated with one another. A stepped portion is formed between the two through holes 222, 221.

In assembly, the screw unit 21 and the resisting unit 22 are placed in the tapered hole 13. The spring is placed between the tapered hole and the resisting unit. The screw unit 21 is screwed into the screw hole 14, while a head of the screw unit 21 resists against the step portion between the through holes 222, 221 and a part of the resisting element 20 exposes from the tapered hole 13.

In the hexagonal spanner of the present invention, the tapered hole and screw hole are formed. By this space, the hexagonal spanner can deform from this portion so as to screw a loosely engaged inner hexagonal screw.

Figure 3:
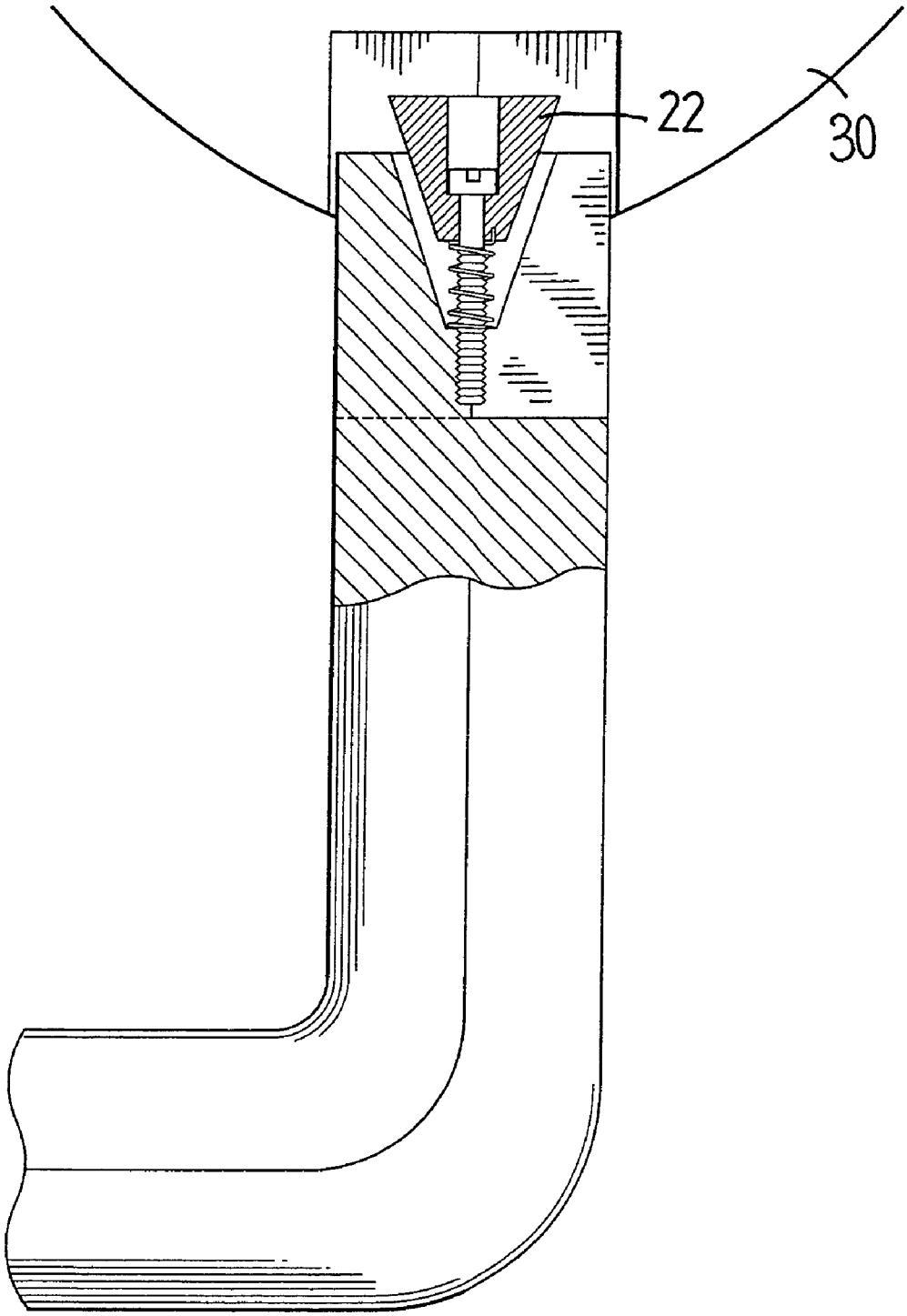
FIG. 3 shows one application of the slide stop device of a hexagonal spanner of the present invention.
Figure 4:
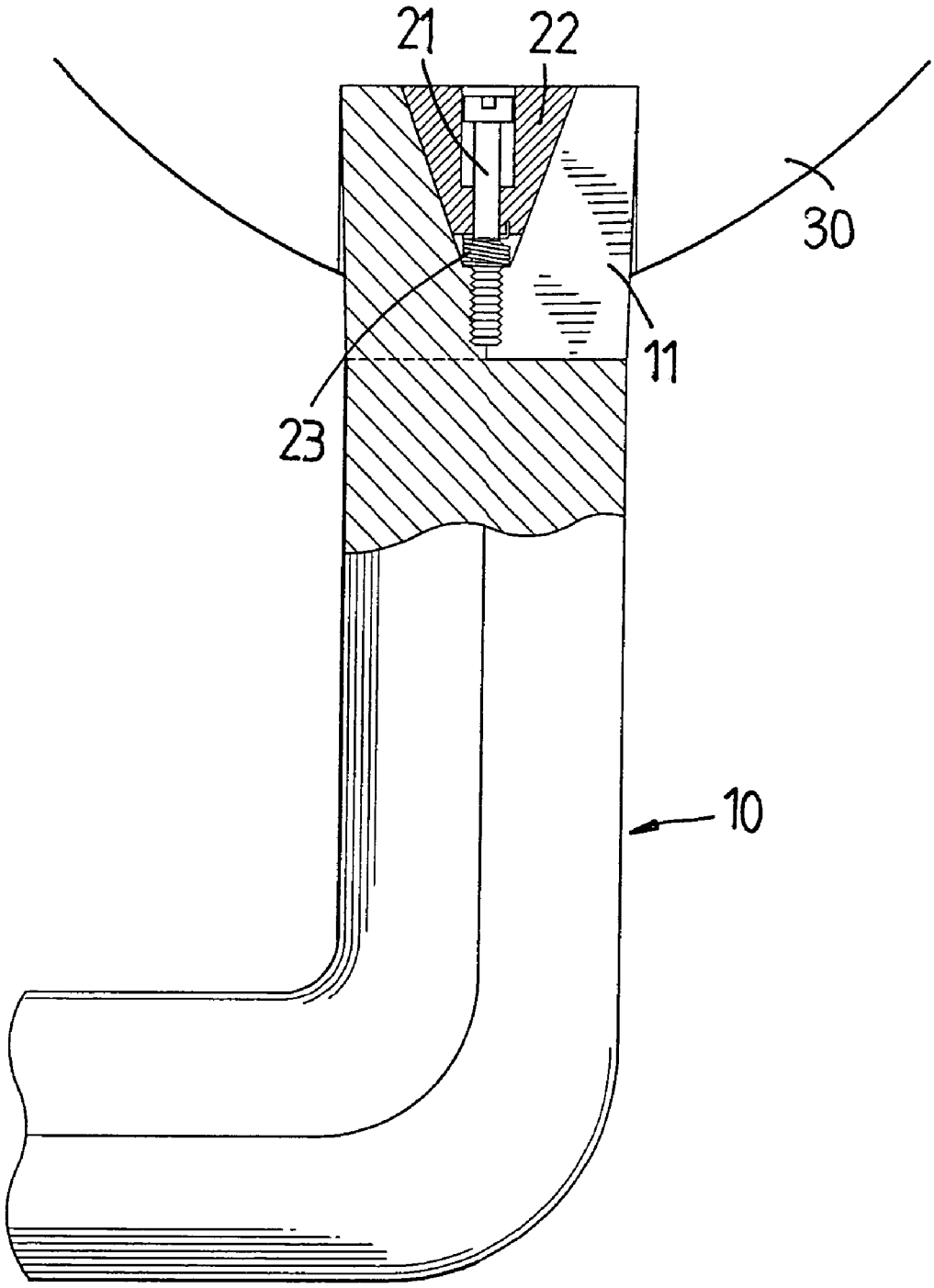
FIG. 4 shows another state in the application of the slide stop device of a hexagonal spanner of FIG. 3.

In use, referring to FIGS. 3 and 4, the screwing resisting element 20 is screwed into the tapered hole 13. When the spanner body 10 is placed in an inner side of an inner hexagonal screw 30, if initially, the hexagonal screw do not fully resists against the spanner body 10 due to, for example, the hexagonal screw 30 has rounded edges. The spanner body 10 is pushed inwards or screwed to cause that the resisting unit 22 to press the spring 23 and resist against the inner wall of the tapered hole 13. Then the driving portion 11 will expand outwards so as to resist against the inner wall of the hexagonal screw 30.

After the spanner body 10 is used, the spring 23 will eject the resisting unit 22 out of the tapered hole 13 so that the driving portion 11 restores to the original position to be used next time.

Figure 5:
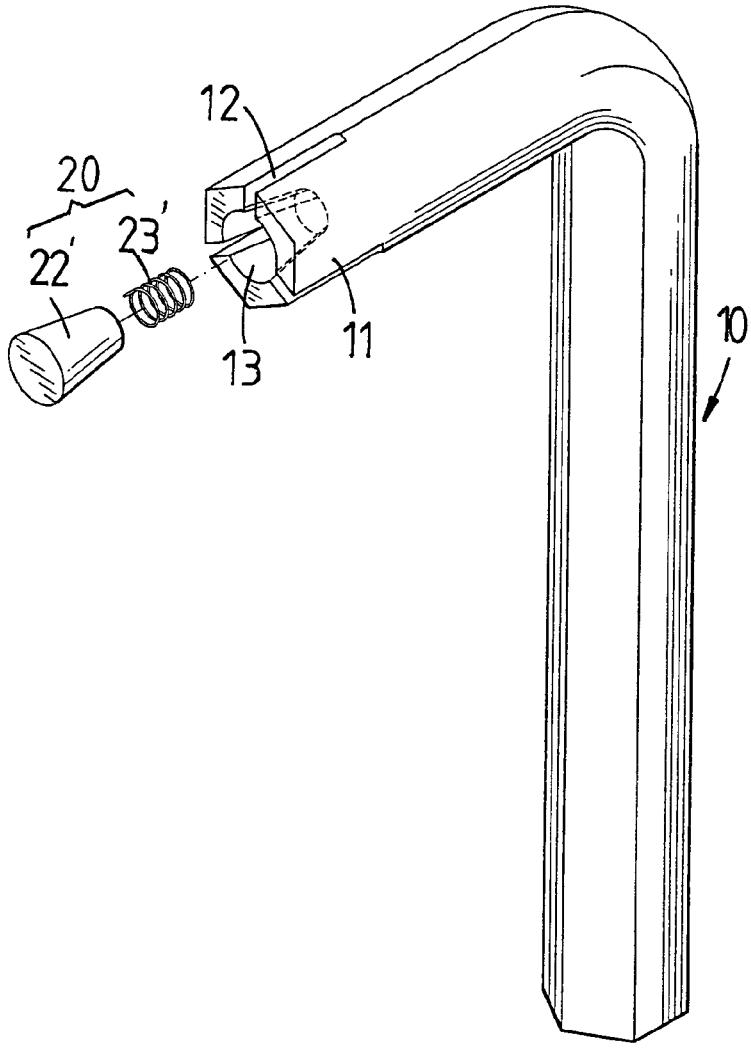
FIG. 5 shows the exploded view of the second embodiment of the slide stop device of a hexagonal spanner of the present invention.
Figure 6:
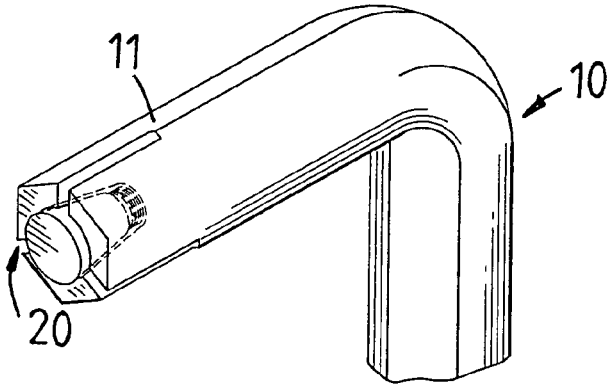
FIG. 6 shows the assembled view of the second embodiment according to the present invention.
Figure 7:
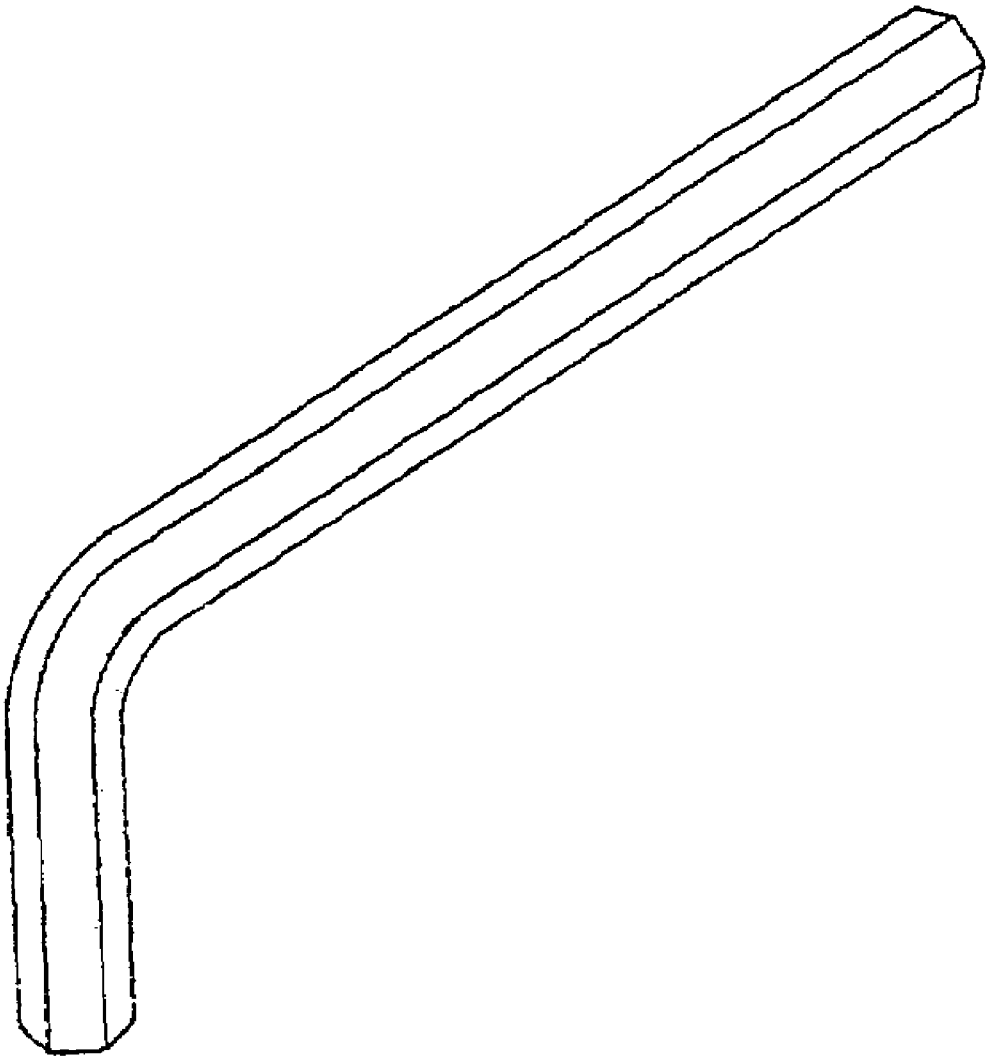
FIG. 7 PRIOR ART
FIG. 7 shows a perspective view of a perspective view hexagonal spanner.

Referring to FIGS. 5 and 6, the second preferred embodiment of the present invention is illustrated.

The resisting element 20 is formed by a tapered resisting unit 22' having a shape corresponding that of the tapered hole 13, and a spring 23'. One end of the spring 23' is fixed to the resisting unit 22' and another end thereof is fixed to the tapered hole 13. Then the same effect as the above embodiment can be achieved with screw hole 14 is formed. Moreover, no through hole, such as the through hole 221, 222 is formed in the resisting unit 22'.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A slide stop device of a hexagonal spanner for preventing a rounded edged inner hexagonal screw to slide as the hexagonal spanner drives the inner hexagonal screw; the slide stop device comprising:

a spanner body; one end of the spanner body having a driving portion; the driving portion having three axial slots; each slot being extended from a center portion of one end surface of the driving portion to lateral side of a hexagonal cross section of the driving portion; a tapered hole being formed along an axial direction of the driving portion; a screw hole extending from an inner side of the tapered hole and being at the same line with the tapered hole; and a resisting element formed by a screw unit, a tapered resisting unit having a shape corresponding to that of the tapered hole, and a spring; the resisting unit having two through holes; two through holes being communicated with one another; a stepped portion is formed between the two through holes; and wherein in assembly, the screw unit and the resisting unit are placed in the tapered hole; and the spring is placed between the tapered hole and the resisting unit; the screw unit is screwed into the screw hole, while a head of the screw unit resists against the step portion between the through holes and a part of the resisting element exposes from the tapered hole.

2. A slide stop device of a hexagonal spanner for preventing a rounded edged inner hexagonal screw to slide as the hexagonal spanner drives the inner hexagonal screw; the slide stop device comprising:

a spanner body; one end of the spanner body having a driving portion; the driving portion having three axial slots; each slot being extended from a center portion of one end surface of the driving portion to lateral side of a hexagonal cross section of the driving portion; a tapered hole being formed along an axial direction of driving portion; and a resisting element formed by a tapered resisting unit having a shape corresponding that of the tapered hole, and a spring; and wherein in assembly, the resisting unit are placed in the tapered hole; and the spring is placed between the tapered hole and the resisting unit; and a part of the resisting element exposes from the tapered hole.

* * * * *